US005433078A

United States Patent [19]

Shin

[11] Patent Number: 5,433,078

[45] Date of Patent: Jul. 18, 1995

[54] HEAT LOSS PREVENTING APPARATUS FOR STIRLING MODULE

[75] Inventor: Dong K. Shin, Kyungki, Rep. of Korea

[73] Assignee: Goldstar Co., Ltd., Seoul, Rep. of Korea

[21] Appl. No.: 235,103

[22] Filed: Apr. 29, 1994

[30] Foreign Application Priority Data

Apr. 29, 1993 [KR] Rep. of Korea ..... 7308/1993

[51] Int. Cl.[6] ..... F02G 1/043

[52] U.S. Cl. ..... 60/517; 60/519; 92/165 R

[58] Field of Search ..... 60/517, 519; 92/165 R, 92/192

[56] References Cited

U.S. PATENT DOCUMENTS

| | | | |
|---|---|---|---|
| 639,999 | 12/1899 | Kennedy | 60/517 |
| 4,271,669 | 6/1981 | Keller et al. | 60/517 |
| 4,446,698 | 5/1984 | Benson | 60/517 |
| 4,736,586 | 4/1988 | Kawajiri et al. | 60/517 |
| 4,887,429 | 12/1989 | Birli, Sr. et al. | 60/531 |

FOREIGN PATENT DOCUMENTS

| | | | |
|---|---|---|---|
| 1907 | 6/1903 | France | 60/517 |
| 7201 | 4/1879 | Germany | 60/517 |
| 355616 | 1/1938 | Italy | 92/192 |

*Primary Examiner*—Ira S. Lazarus
*Assistant Examiner*—L. Heyman
*Attorney, Agent, or Firm*—Ostrolenk, Faber, Gerb & Soffen

[57] ABSTRACT

The present invention relates to a heat loss preventing apparatus for preventing a working gas of a high temperature which exist in an expansion space to flow directly to a compression space by providing a tip upwardly formed with the displacer and integrally provided in a form of cylinder at an upper end thereof and a baffle downwardly formed with an end of the cylinder and integrally provided at an upper portion of end of the cylinder, thereby increasing a heat efficiency of Stirling module, in particular more effectively reducing the heat loss by providing the tip and the baffle when the displacer is positioned either at a top dead point or at a bottom dead point.

3 Claims, 4 Drawing Sheets

HEAT LOSS PREVENTING APPARATUS FOR STIRLING MODULE

BACKGROUND OF THE INVENTION

1. Field of the Invention

The present invention relates to a heat loss preventing apparatus for the Stirling module which prevents a part of working gas, which exists in an expansion space in a cylinder of the Stirling module, from flowing directly to a compression space not through a heat exchanger such as a regenerator and a radiator.

2. Description of the Prior Art

Referring to FIG. 1, a conventional Stirling module includes a heat receiving portion 1 for receiving an outside heat thereof, a regenerator 2 for regenerating the heat received from the heat receiving portion 1, a radiator 3 for discharging the heat from the regenerator 2, a cylinder 8 having an expansion space A provided at an inner upper side thereof and a compression space B provided at an inner lower side thereof, a displacer 4 for expanding or compressing the expansion space A and the compression space B, a piston 5 for compressing the compression space B, a driving section 6 provided at a lower portion of the piston 5 for driving the displacer 4 and the piston 5, and a displacer ring 7 provided between an outer surface of the displacer 4 and the inner surface of the cylinder 8.

The conventional Stirling module is operated as follows.

As the displacer 4 moves to a top dead point of the cylinder 8, a working gas of a high temperature in the expansion space A flows to the compression space B through the regenerator 2 and the radiator 3. In this case, as the displacer 4 is provided for a smooth operation between an outer surface of the displacer 4 and the inner surface of the cylinder 8.

However, at this time, a part of the working gas of high temperature directly moves to the compression space B through a gap between the outer surface of the displacer 4 and the inner surface of the cylinder 8 not through the regenerator 2 and the radiator 3 which are a heat exchanger, due to a high pressure of the working gas of the high temperature in the expansion space A.

In the Stirling module, the displacer ring 7 conventionally plays a role to decrease a friction between the outer surface of the displacer 4 and the inner surface of the cylinder 8, so it has not so good properties for preventing a gas flow through the gap between the outer surface of the displacer 4 and the inner surface of the cylinder 8. Since the working gas of high temperature in the expansion space A, mixed with other working gas which has passed through the heat exchanger, flows directly to the compression space B not through the regenerator 2 and the radiator 3, the heat efficiency is decreased in the Stirling module.

SUMMARY OF THE INVENTION

Accordingly, it is an object of the present invention to provide a heat loss preventing apparatus for preventing a part of working gas from flowing from an expansion space to a compression space through a gap between an outer surface of a displacer and an inner surface of a cylinder not through a regenerator and a radiator which are heat exchanger, when the displacer moves to a top dead point.

To achieve the above object, the present invention includes a cylinder having a heat receiving portion at an upper outer portion thereof, a displacer provided at an inner upper portion of the cylinder, a piston provided at a lower portion of the displacer inside the cylinder, a driving section for driving the displacer and the piston, and a tip and a baffle provided at an upper end of the displacer and the cylinder, respectively, for preventing working gas from flowing from the expansion space to the compression space through a gap between an outer surface of the displacer and an inner surface of the piston.

DESCRIPTION OF THE PREFERRED EMBODIMENTS

Figure 1:
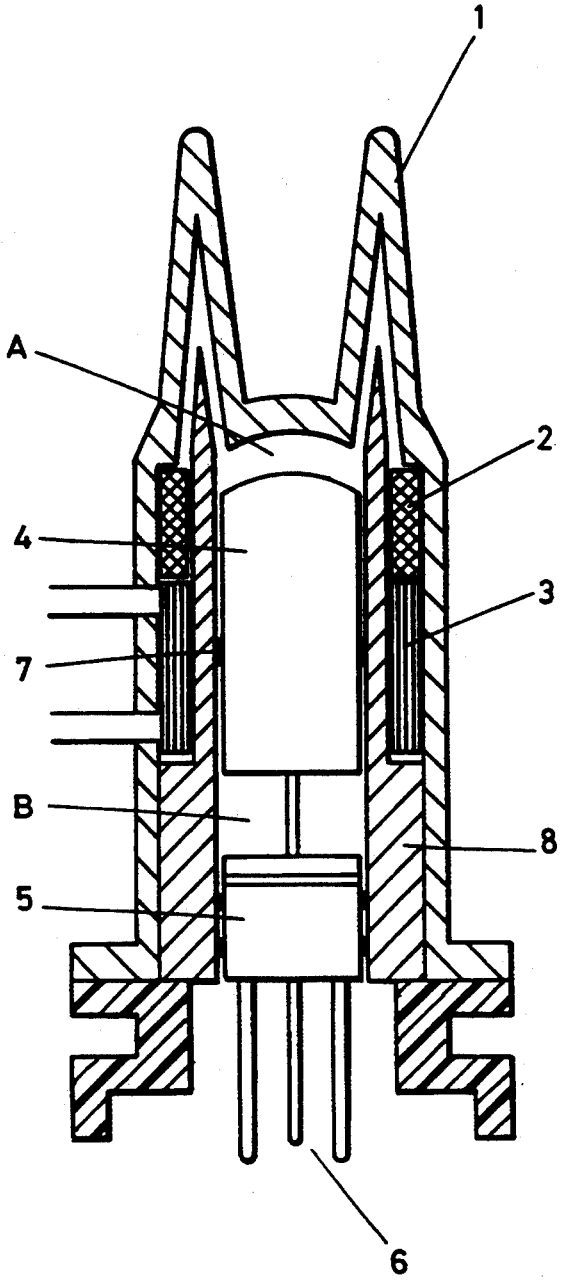
FIG. 1 CONVENTIONAL ART
FIG. 1 is a sectional view showing a construction of a conventional Stirling module.
Figure 2:
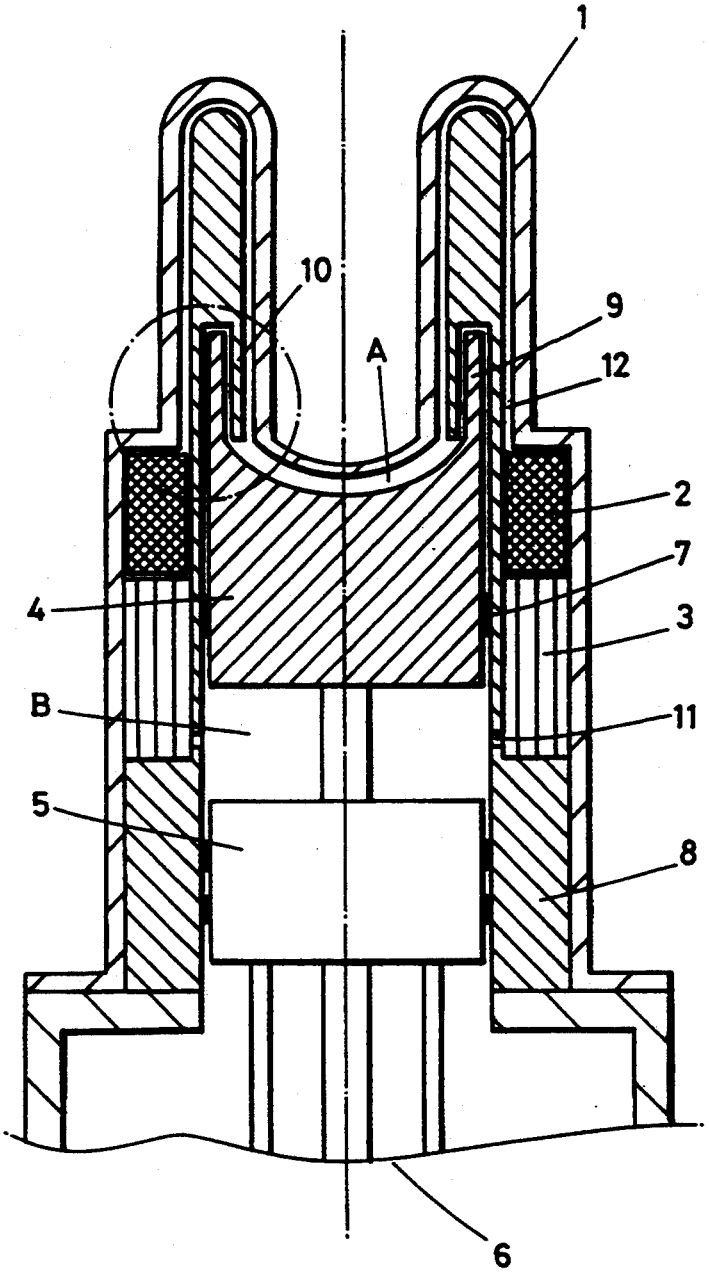
FIG. 2 is a sectional view showing the Stirling module with a heat loss preventing apparatus according to the present invention.

Referring to FIG. 2, it is a sectional view showing Stirling module according to the present invention. As shown in the figure, a displacer 4 is provided at an upper portion inside the cylinder 8 and a piston 5 is provided at a lower portion thereinside. An expansion space A is formed between an upper portion of the displacer 4 and an inside of the cylinder 8. A compression space B is formed between the lower portion of the displacer 4 and the upper portion of the piston 5.

In addition, the present invention includes a heat receiving portion 1 for receiving the heat from an outside thereof, a regenerator 2, provided at one portion of an outside of the cylinder 8, for regenerating the heat of high temperature which flowed through a gas path 12 from the expansion space A, the radiator 3 provided at an outside of the cylinder 8 for discharging the heat received from the regenerator 2 to an outside of the cylinder 8, a displacer ring 7 provided at an outer surface of the displacer 4 for decreasing a friction between the outer surface of the displacer 4 and the inner surface of the cylinder 5. A tip 9 according to the present invention is integrally formed with the displacer 4 and upwardly provided at an upper portion of the displacer 4, having a predetermined length with a form of a cylinder and the same diameter with that of the displacer 4 and a baffle 10 which is always positioned inner side of the tip 9 when the displacer 4 works, provided at an inner upper portion of the cylinder 8 with a smaller diameter than that of the tip 9. A gas hole 11 is provided between the compression space B and the radiator 3 for flowing the working gas therethrough. A gas path 12 is provided for flowing the working gas from the expansion space A to the regenerator 2 and the radiator 3.

The more detailed description of the operation according to the present invention will be provided hereinunder.

In the Stirling module, the displacer 4 works for distributing the working gas in the expansion space A and the compression space B to the compression space B and the expansion space A and compressing the working gas in the expansion space A and the compression space B.

In FIG. 2, when the displacer 4 moves to a top dead point, the working gas of high temperature in the expansion space A flows to the regenerator 2 through the gas path, at this time, the working gas of high temperature loses its heat there, after that, flows to the compression space B through the radiator 3 and the gas hole 11. The regenerator 2 discharges the heat stored therein to the radiator 3, and the radiator 3 discharges the heat of high temperature to the outside of the cylinder 8. In the compression space B, the working gas, the heat of which is deprived of from the regenerator 2 and the radiator 3, flows to the expansion space A through the gas hole 11, the radiator 3, the regenerator 2, the gas path 12 by a pressure of the working gas in the expansion space A, which occurs when the displacer 4 moves to the bottom dead point and the piston 5 moves to the top dead point. At this time, before the working gas of low temperature reaches at the expansion space A, the displacer 4 moves to the bottom dead point, at the same time, the expansion space A becomes a state of low temperature, so that the working gas of low temperature exists in the expansion space A. At this time, the working gas of low temperature plays a role of exchanging the heat between the heat receiving portion 1 and the expansion space A, and then the working gas which is in a state of low temperature due to the heat exchanging again compressed when the displacer 4 moves to the top dead point of the cylinder 8, and again flows to the compression space B through the gas path 12 and becomes the working gas of low temperature.

With above constructions and operations, Stirling module according to the present invention obtains the cooling effects therein.

In the present invention, the tip 9 and the baffle 10 play a role to prevent the working gas from flowing through a gap between the outer surface of the displacer 4 and the inner surface of the cylinder 8 by the pressure in the expansion space A when the displacer 4 moves to the top dead point, not through the regenerator 2 and radiator 3.

As shown in FIG. 2, when the displacer 4 moves to the top dead point, by providing the tip 9 and the baffle 10, a part of the working gas in the expansion space A which flows to the gap between the outer surface of the displacer 4 and the inner surface of the piston 5 is effectively prevented by means of resistances at an elongated gap between the tip 9 and the baffle 10 according to the present invention.

Figure 3:
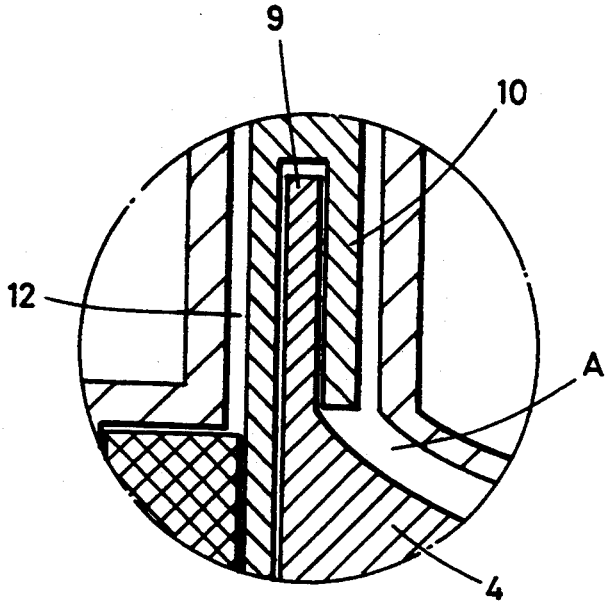
FIG. 3 is a sectional view showing a state that a displacer is positioned at a top dead point as an operational view according to the present invention.
Figure 4:
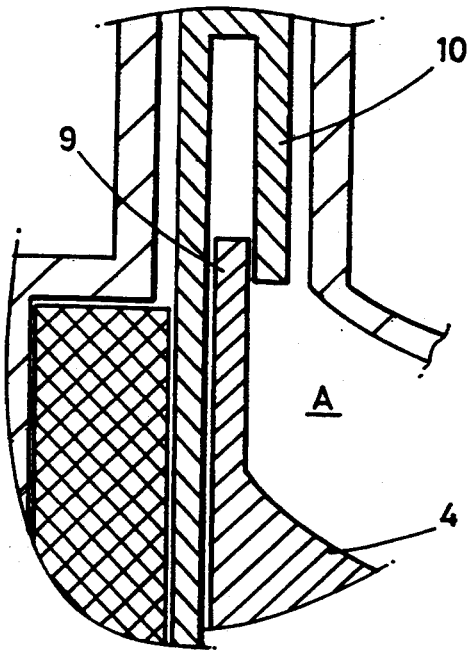
FIG. 4 is a sectional view showing a state that said displacer is positioned at a bottom dead point as an operational view according to the present invention.

FIGS. 3 and 4 are an operational view according to the present invention.

FIG. 3 is a view in which the displacer 4 is positioned at the top dead point of the cylinder 8. In the state, the tip 9 and the baffle 10 are overlapped each other along the entire length thereof.

FIG. 4 is a view which the displacer 4 is positioned at the bottom dead point of the cylinder 8. In the state, the tip 9 and the baffle 10 are overlapped each other at ends thereof.

In addition, by making the tip 9 and the baffle 10 be always overlapped as shown in FIGS. 3 and 4 when the displacer 4 is positioned either at the top dead point or at the bottom dead point, the working gas in the expansion space A can not flow through a gap between the outer surface of the displacer 4 and the inner surface of the cylinder 8.

Figure 5:
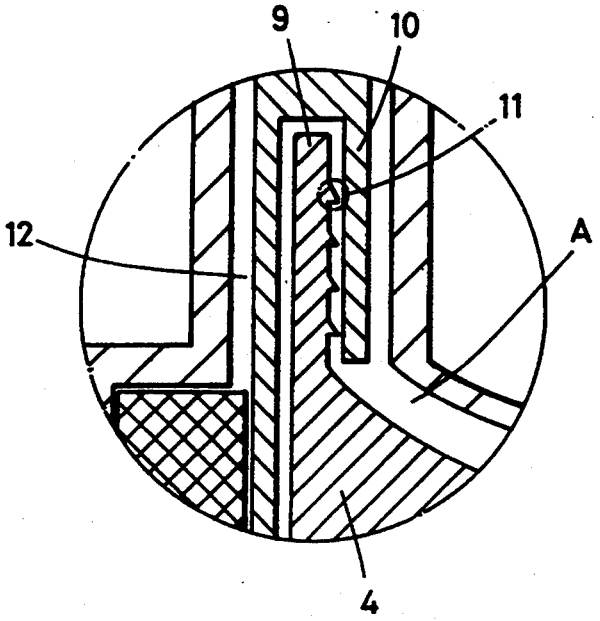
FIG. 5 is a sectional view showing another embodiment of a heat loss preventing apparatus for the Stirling module according to the present invention.

FIG. 5 is a sectional view showing another embodiment of the heat loss preventing apparatus according to the present invention. This embodiment is characterized in that a plurality of protrusions are provided at one surface of the tip 9 which is confronting with a surface of the baffle 10. By providing these protrusions, it can effectively prevent the flow of the working gas through a gap between the outer surface of the displacer 4 and the inner surface of the cylinder 8.

As described above, the present invention provides the effects that the heat efficiency is enhanced by providing the tip and the baffle, thereby effectively preventing the heat loss through the gap between the outer surface of the displacer and the inner surface of the cylinder.

What is claimed is:

1. A heat loss preventing apparatus for Stirling module, comprising:

a cylinder including a heat receiving portion at an upper outer portion thereof;

a displacer provided at an inner upper portion of said cylinder;

a piston provided at a lower portion of said displacer inside the cylinder;

a driving section for driving the displacer and the piston;

means for preventing working gas from flowing from said expansion space to said compression space through a gap between an outer surface of the displacer and an inner surface of the cylinder; and wherein said preventing means includes a tip cylindrically integrally formed with the displacer and upwardly provided at an upper side thereof, having the same diameter with that of the displacer and a predetermined length and a baffle cylindrically integrally formed with the cylinder and downwardly provided at an end of an upper portion thereof, having a smaller diameter than that of said tip and a predetermined length.

2. The apparatus of claim 1, wherein said tip and said baffle are overlapped when the displacer is in a top dead point and when the displacer is in a bottom dead point.

3. The apparatus of claim 1, wherein said tip or said baffle includes a plurality of protrusions at least on one surface thereof.

* * * * *